US010816175B2

(12) United States Patent
Gielen et al.

(10) Patent No.: US 10,816,175 B2
(45) Date of Patent: Oct. 27, 2020

(54) LUMINAIRE FOR MOUNTING ON A POLE

(71) Applicant: SIGNIFY HOLDING B.V., Eindhoven (NL)

(72) Inventors: Vincent Stefan David Gielen, Gastel (NL); Antonius Adrianus Maria Marinus, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/641,900

(22) PCT Filed: Sep. 4, 2018

(86) PCT No.: PCT/EP2018/073684
§ 371 (c)(1),
(2) Date: Feb. 25, 2020

(87) PCT Pub. No.: WO2019/048406
PCT Pub. Date: Mar. 14, 2019

(65) Prior Publication Data

US 2020/0200374 A1 Jun. 25, 2020

(30) Foreign Application Priority Data

Sep. 7, 2017 (EP) ..... 17189958

(51) Int. Cl.
*F21V 21/116* (2006.01)
*F21V 29/70* (2015.01)
(Continued)

(52) U.S. Cl.
CPC ..... *F21V 21/116* (2013.01); *F21S 8/086* (2013.01); *F21V 21/108* (2013.01); *F21V 21/30* (2013.01);
(Continued)

(58) Field of Classification Search
CPC ..... F21V 21/116; F21V 23/008
See application file for complete search history.

(56) References Cited

U.S. PATENT DOCUMENTS

2007/0019420 A1* 1/2007 Farmer ..... F21S 6/006 362/410
2007/0081338 A1 4/2007 Kuan
(Continued)

FOREIGN PATENT DOCUMENTS

CN 101532624 A 9/2009
CN 102062325 A 5/2011
(Continued)

*Primary Examiner* — Evan P Dzierzynski
*Assistant Examiner* — Keith G. Delahoussaye
(74) *Attorney, Agent, or Firm* — Daniel J. Piotrowski

(57) ABSTRACT

A luminaire (1) for mounting on a pole is disclosed. The luminaire (1) comprises: a lighting unit (17); a driver compartment (8) housing a driver (9) electrically connected to the lighting unit (17); and a pole compartment (3) adapted to receive an end portion of the pole, the pole compartment (3) extending along a longitudinal axis (L) along which said end portion is arranged when received by the pole compartment (3), wherein the pole compartment (3) and the driver compartment (5) are arranged adjacent to each other in a direction (D) perpendicular to the longitudinal axis (L), and wherein the driver compartment (8) and the lighting unit (17) are arranged at a distance from each other along the longitudinal axis (L). A street lamp comprising the luminaire (1) is also disclosed.

12 Claims, 4 Drawing Sheets

(51) Int. Cl.

| | |
|---|---|
| ***F21S 8/08*** | (2006.01) |
| ***F21V 21/108*** | (2006.01) |
| ***F21V 21/30*** | (2006.01) |
| ***F21V 23/00*** | (2015.01) |

(52) U.S. Cl.
CPC ..... *F21V 23/001* (2013.01); *F21V 23/008* (2013.01); *F21V 29/70* (2015.01)

(56) References Cited

U.S. PATENT DOCUMENTS

| | | | | |
|---|---|---|---|---|
| 2008/0285265 | A1 | 11/2008 | Boissevain | |
| 2010/0302765 | A1* | 12/2010 | Yu ..... | F21S 9/037 362/183 |
| 2011/0060701 | A1 | 3/2011 | Verfuerth et al. | |
| 2012/0300481 | A1 | 11/2012 | Kim et al. | |
| 2013/0279172 | A1 | 10/2013 | Wang | |
| 2015/0362172 | A1 | 12/2015 | Gabriel et al. | |

FOREIGN PATENT DOCUMENTS

| | | | |
|---|---|---|---|
| CN | 203099569 | U | 3/2013 |
| KR | 101595905 | B1 | 2/2016 |

* cited by examiner

LUMINAIRE FOR MOUNTING ON A POLE

CROSS-REFERENCE TO PRIOR APPLICATIONS

This application is the U.S. National Phase application under 35 U.S.C. § 371 of International Application No. PCT/EP2018/073684, filed on Sep. 4, 2018, which claims the benefit European Patent Application No. 17189958.6, filed on Sep. 7, 2017. These applications are hereby incorporated by reference herein.

FIELD OF THE INVENTION

The present invention relates to a luminaire for mounting on a pole, such as a luminaire used in street lighting.

BACKGROUND OF THE INVENTION

Many commonly-occurring luminaires for indoor and outdoor use are intended to be mounted on a pole. An example is the lamp for street lighting disclosed in the document KR1691622B1. The lamp is attached to an end of a connection part which is bolt-mounted to the top of a roadside pole. While this and other existing pole-mounted luminaires are suitable for their intended use, they are subject to improvement. For example, there is a need for continued innovation efforts aimed at facilitating maintenance and repair work, increasing reliability and lifetime, and/or decreasing production costs. There is also a need to develop luminaires that can be mounted in a more stable manner to the pole than prior art luminaires.

SUMMARY OF THE INVENTION

An object of the present invention is to provide a luminaire which at least partially addresses one or more of the above-mentioned needs. According to a first aspect of the invention, this and other objects are achieved by a luminaire for mounting on a pole, the luminaire comprising: a lighting unit; a driver compartment housing a driver electrically connected to the lighting unit; and a pole compartment adapted to receive an end portion of the pole, the pole compartment extending along a longitudinal axis along which said end portion is arranged when received by the pole compartment, wherein the pole compartment and the driver compartment are arranged adjacent to each other in a direction perpendicular to the longitudinal axis, and wherein the driver compartment and the lighting unit are arranged at a distance from each other along the longitudinal axis.

The term "pole" should be interpreted broadly and is here meant to include, for example, poles that are intended to be mounted vertically upright on the ground and poles that are intended to extend, either parallel or inclined to the horizontal, from an inner or outer wall of a building.

The driver is relatively heavy, and putting the driver compartment adjacent to the pole compartment results in the luminaire's center of gravity being close to the pole, something which greatly increases the stability of the luminaire. If desired, the stability may be further increased by making the pole compartment longer, and the design of the luminaire is such that this can be done easily and without the need to make significant adjustment to the other components of the luminaire. The robust mounting of the luminaire makes the luminaire suitable for many applications and safe to work with once installed on a pole. Also, the robust mounting also makes the luminaire especially suitable for use with large lighting units and drivers.

Further, the driver is sensitive to excessive heat, which may reduce its lifetime and reliability. Positioning the driver and the lighting unit at a distance from each other along the longitudinal axis helps to protect the driver from the heat generated by the lighting unit, without compromising stability, and thereby to extend its lifetime and to increase its reliability.

Still further, the innovative separation of the driver and the lighting unit allows for a modular design which consists of a very small number of parts that are easy to assemble and disassemble independently. This facilitates production as well as maintenance and repair work, something which reduces costs and benefits the environment. The serviceable design makes the luminaire especially well-suited to meet many of the so-called "circular economy" requirements.

The luminaire might have the feature that the lighting unit and the driver compartment, configured to accommodate the driver, are arranged on opposite sides of the longitudinal axis, typically to be considered in the case the lighting unit is positioned so as to extend away from a redirection module in a direction which is essentially parallel with the longitudinal axis L, i.e. in a stretched configuration. Said redirection module enables rotation of the lighting unit about a rotation axis. Arranged on opposite sides in this context means that the center of mass of respectively the driver and the lighting unit are on opposite sides of the longitudinal axis. Arranging the lighting unit and the driver in such a way results in a particularly well-balanced weight distribution that increases the stability of the luminaire when mounted to the pole, because the lighting unit and the driver act as counterweights to each other. It should, however, be noted that the lighting unit and the driver may be arranged differently. For example, the lighting unit and the driver may be arranged on the same side of the longitudinal axis and then, as a counterbalance, an extra counterweight may be provided on the opposite side of the longitudinal axis. Then, preferably the counterweight is accommodated inside a wheel of the redirection module enabling rotation of the lighting unit about a rotation axis.

The lighting unit may be arranged to be rotatable about a rotation axis which is perpendicular to the longitudinal axis and to the above-mentioned direction in which the pole compartment and the driver compartment are adjacently arranged. This makes the luminaire's general direction of illumination variable and, thus, the luminaire becomes adaptable to different lighting requirements.

The luminaire may comprise a redirection module arranged between the lighting unit and the driver compartment along the longitudinal axis, wherein the lighting unit is mounted to the redirection module so as to be rotatable about the rotation axis. The redirection module may comprise an arm rotatable about the rotation axis, wherein the lighting unit is mounted to the arm.

The lighting unit may be electrically connected to the driver via an interior connection. By the connection being an "interior connection" is meant that the components, such as connectors and electrical cables, which connect the lighting unit to the driver are not exposed to the exterior of the luminaire. Such a connection helps to protect a worker from the risk of electric shock during, for example, the maintenance or repair work.

The driver may comprise a first heat sink and the lighting unit may comprise a second heat sink, the second heat sink being separate from the first heat sink. Using separate heat sinks for the driver and the lighting unit, rather than just one heat sink for both components as is often the case in the prior art, results in a more efficient cooling of these components. This increases, in particular, the lifetime of the driver, since the lifetime of the driver is significantly shortened by excessive exposure to heat.

The pole compartment may be open that so as to allow the pole to be inserted along the longitudinal axis into the pole compartment. This makes the mounting of the luminaire fast and easy, something which enhances worker safety.

The luminaire may have the feature that it comprises a locking member arranged inside the pole compartment, the locking member being fixable at different positions along an axis parallel to the above-mentioned direction in which the pole compartment and the driver compartment are adjacently arranged. That is, this axis may be perpendicular to the aforementioned longitudinal axis and to the aforementioned rotation axis. Typically the locking member comprises a plate and a plurality of screws mutually arranged in axial direction in through holes in the plate. The plate preferably has a substantially V-shaped cross-section and is displaceable in direction D essentially perpendicular to the longitudinal axis L, for example to clamp the pole between the locking member and an inner wall of the pole compartment. Such a movable locking member makes it possible to fix the luminaire securely to the pole and also makes it possible to mount the luminaire to poles of significantly different diameters, for example diameters that may differ in a ratio of 1.2 to5.

The pole compartment may comprise an inner wall, and the inner wall and the locking member may be capable of pressing against a pole inserted into the pole compartment at three or more contact regions. This enables the pressing force on the pole to be distributed over different parts on the pole in such a manner that a particularly robust mounting of the luminaire to the pole is achieved.

The driver compartment and the pole compartment are formed by a single housing. This reduces the number of components and makes it possible to speed up production.

The housing may be extruded. These are a particularly simple, quick and inexpensive ways of producing the housing. They also make it especially easy to adapt the housing to drivers of different sizes and to vary the length of the pole compartment.

According to a second aspect of the invention, there is provided a street lamp comprising a luminaire according to the first aspect of the invention and a pole for being installed on the ground in an upright position, wherein an end portion of the pole is inserted into the pole compartment of the luminaire.

The effects and features of the second aspect of the invention are similar to those of the first aspect of the invention.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
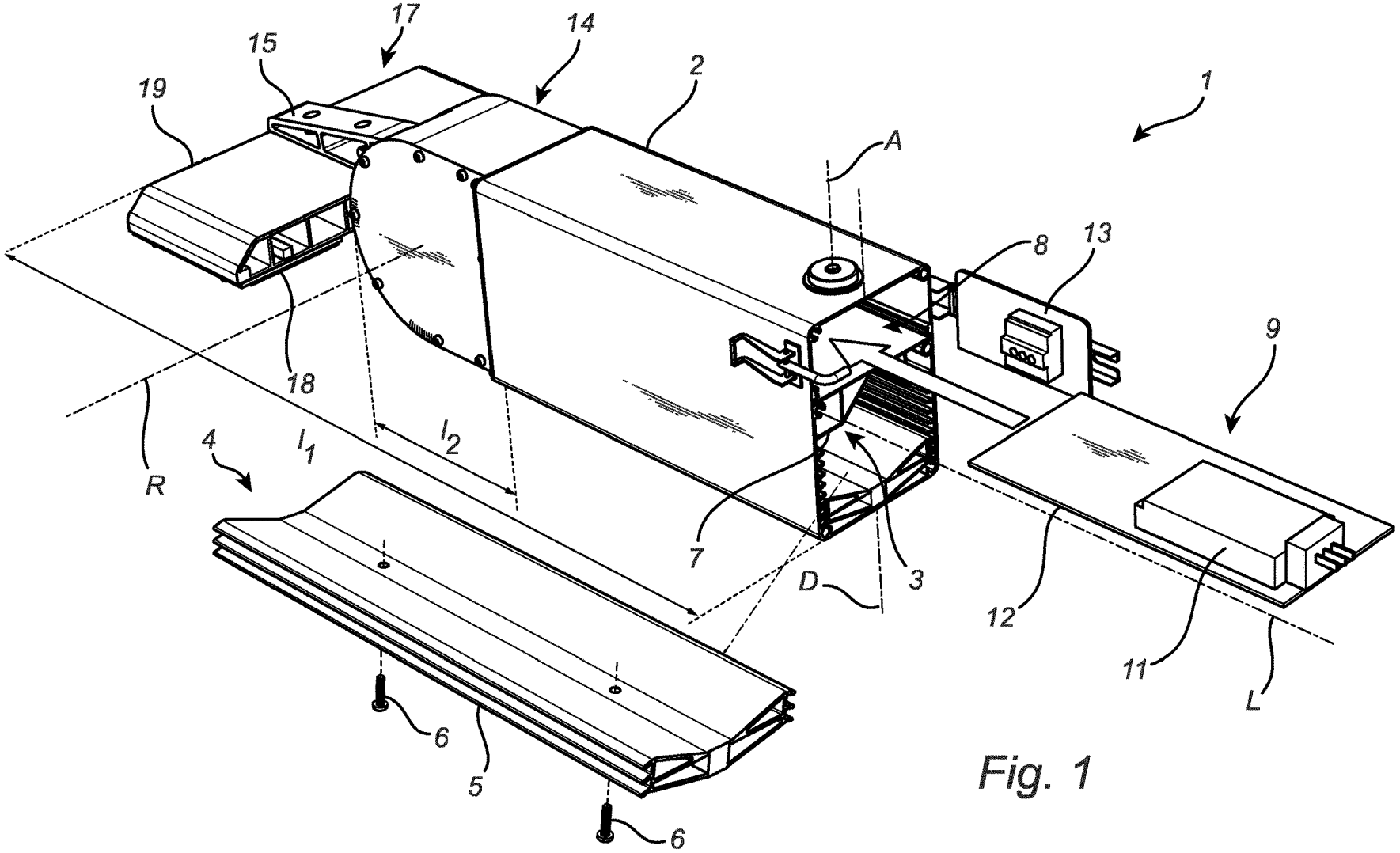
FIG. 1 shows a perspective view of a luminaire according to an embodiment of the invention.
Figure 2:
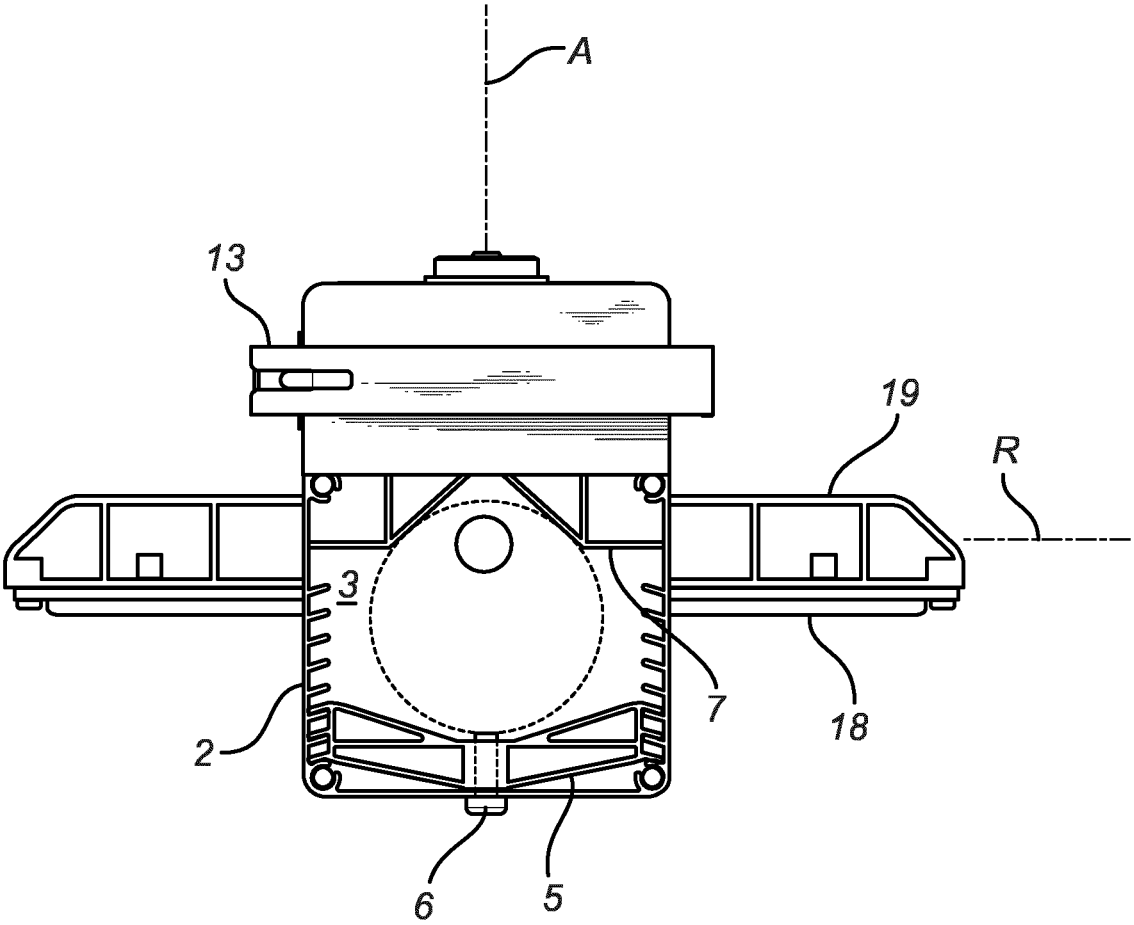
FIG. 2 shows a side view of the luminaire in FIG. 1.
Figure 3:
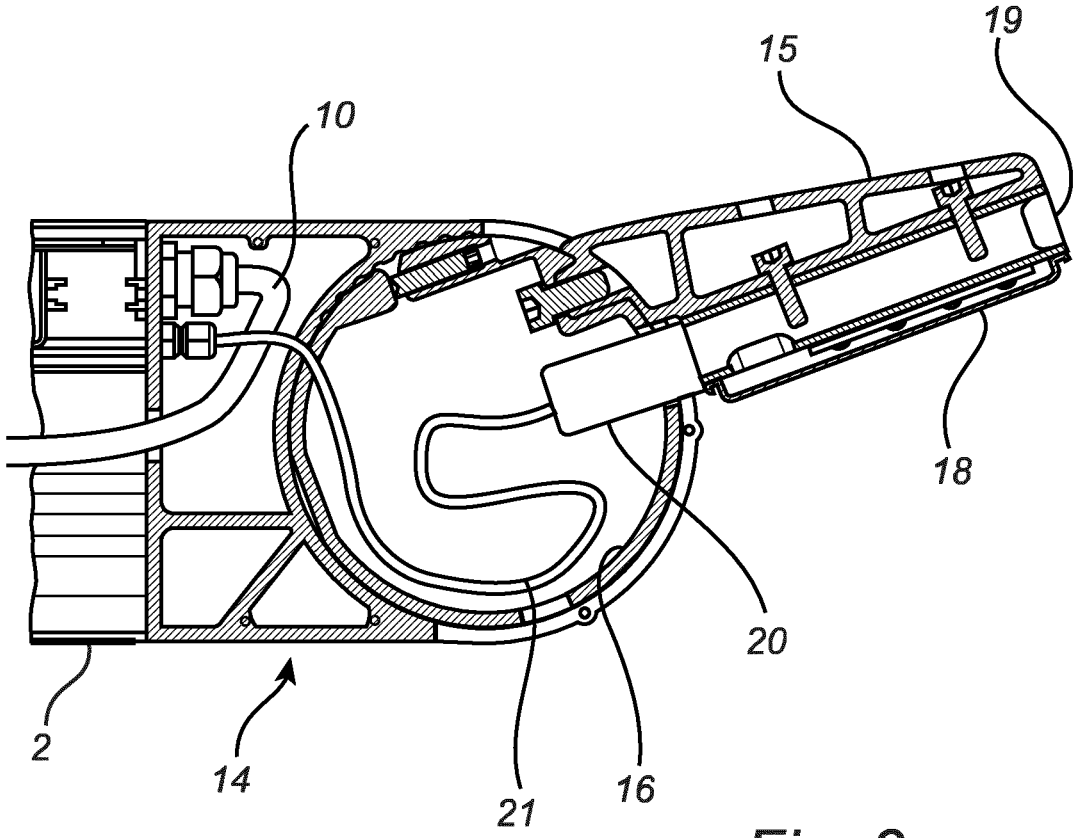
FIG. 3 shows a cross-sectional side view of a part of the luminaire in FIG. 1.

FIGS. 1 to 3 show a luminaire 1 which is adapted to be mounted on a pole, such as the pole of a street lamp or a pole mounted to an interior or exterior wall of a building. The luminaire 1 has a housing 2. The illustrated housing 2 is extruded and made of a plastic material. However, it is possible to produce the housing 2 using other techniques and/or materials. Which techniques and/or materials to use depend partly on the intended use of the luminaire 1, such as indoor or outdoor use. Examples of suitable housing materials include metals (for example aluminum, diecast aluminum and steel), plastics (for example PC, PBT and PA) and glass.

The housing 2 forms a pole compartment 3 adapted to receive an end portion of a pole. The pole compartment 3 has an elongated shape and defines along a longitudinal axis L. The end portion of the pole extends along the longitudinal axis L when inserted into the pole compartment 3. In the illustrated example, one inserts the pole in to the pole compartment 3 through an opening which is located at a longitudinal end of the housing 2. The insertion direction is parallel with the longitudinal axis L. The pole compartment 3 is usually adapted to receive an end portion having a length somewhere in the range from 5 cm to 20 cm.

A locking member 4 for securing a pole to the luminaire 1 is arranged inside the pole compartment 3. The locking member 4 comprises a plate 5 and a plurality of screws 6, here two screws (see FIG. 1), mutually arranged in axial direction in through holes in the plate 5. The plate 5 preferably has a substantially V-shaped cross-section and is displaceable in direction D essentially perpendicular to the longitudinal axis L. The locking member 4 is positionable at different locations along an axis A perpendicular to the longitudinal axis L. Poles of different diameters can be accommodated by adjusting the position of the locking member 4. The luminaire 1 is usually capable of accommodating poles having a diameter in the range from 30 mm to 150 mm, for example 80 mm.

The locking member 4 is capable of securing a pole (illustrated by dashed lines in FIG. 2) inserted into the pole compartment 3 to the luminaire 1 by pressing the pole against an interior wall 7 of the pole compartment 3. In the illustrated example, a central portion of the interior wall 7 has a V-shaped cross section. Further, in the illustrated example, the locking member 4 and the interior wall 7 are arranged so that pressing forces are applied to the pole at four separate contact regions, or locations. Two of these contact regions have a point-like shape and are between the pole and the screws 6. The other two of the contact regions are between the pole and the two "legs" of the V-shaped central portion of the interior wall 7, and these contact regions are elongated and straight.

The housing 2 further has a driver compartment 8 which is arranged adjacent to the pole compartment 3 in a direction D perpendicular to the longitudinal axis L. The driver compartment 8 and the pole compartment 3 are thus arranged adjacent to each other, and, in this case, both compartments 3, 8 are formed by the housing 2, so the compartments 3, 8 are formed by a single housing. A driver 9 is housed inside the driver compartment 8. The driver 9 is connectable to a power source, such as the mains, via a cable 10 (see FIG. 3). Further, the driver 9 includes electrical circuitry 11 connected to power the lighting unit 17 (further described below) and a heat sink 12, henceforth referred to as the first heat sink 12. The first heat sink 12 is in thermal connection with the electrical circuitry 11, and, during operation of the luminaire 1, the first heat sink 12 transfers heat way from the electrical circuitry 11. The first heat sink 12 is usually made of a metal or a plastic material. The driver 9 is mounted so as to be easily removable from driver compartment 8 in case the driver 9 needs to be replaced or repaired. In the illustrated example, the driver compartment 8 can be accessed through an opening located next to the above-mentioned opening to the pole compartment 3. The opening to the driver compartment 8 is closable by a door 13. The door 13 is typically provided with locking means that makes it possible to lock and unlock the door 13 without the use of tools.

A redirection module 14 is attached to the housing 2 at a longitudinal end thereof. More precisely, the redirection module 14 is attached to the longitudinal end that is opposite to the end with the openings into pole and driver compartments 3, 8. The redirection module 14 may comprise parts that are extruded. Those parts are typically made of a metal (for example aluminum, diecast aluminum or steel) or a plastic material (for example PVC or PC).

The redirection module 14 includes an arm 15 extending away therefrom. The arm 15 may alternatively be referred to as a bracket. In the illustrated example the arm 15 has a wedge-like shape, but the arm 15 is not limited to that shape. The arm 15 is rotatable about a rotation axis R perpendicular to the longitudinal axis L and to the axis A. Specifically, in the illustrated example, the arm 15 is attached to a wheel 16 which is arranged inside the redirection module 14 and which is rotatable about the rotation axis R. Through rotation about the rotation axis R, the arm 15 is movable to and fixable at various predefined positions at which the arm 15 makes different angles with the longitudinal axis L. The predefined positions may for example be separated from each other by 5 degrees. The arm 15 may be fixable at the predefined positions by means of a single screw.

A lighting unit 17 is rigidly mounted to the arm 15, typically in a way that allows for the lighting unit 17 to be attached and re-attached without the use of tools. The lighting unit 17 comprises a light source 18 mounted on a heat sink 19, henceforth referred to as the second heat sink 19. The light source 18 is in thermal connection with the second heat sink 19, and, during operation of the luminaire 1, the second heat sink 19 transfers heat way from the light source 18. Thus, in the illustrated example, the light source 18 of the lighting unit 17 and the electrical circuitry 11 of the driver 9 are cooled by different heat sinks 12, 19. The arm 15 and the light source 18 are attached to the second heat sink 19 on opposite sides thereof. The light source 18 typically comprises several solid-state lighting elements capable of emitting light, such as light-emitting diodes. The second heat sink 19 may be extruded. The second heat sink 19 can for example be made of a metal, such as aluminum. As can be seen in FIGS. 1 and 2, the illustrated light source 18 and second heat sink 19 both have a planar, rectangular shape. However, these components are not limited to that particular shape and both or one of them may have a different shape in another example.

Since the arm 15, as noted above, is rotatable about the rotation axis R, the lighting unit 17 is also rotatable about the rotation axis R. In FIG. 1, the lighting unit 17 is positioned so as to extend away from the redirection module 14 in a direction which is substantially parallel with the longitudinal axis L, i.e. in a stretched configuration. When oriented in that way, the total length $l_1$ of the luminaire 1 along the longitudinal axis L is typically in the range from 70 cm to 130 cm. By rotating the lighting unit 17, it is possible to change its position. For example, the lighting unit 17 may be positioned so as to extend away from the redirection module 14 in a radial direction which is perpendicular, or substantially perpendicular, to the longitudinal direction L (see FIG. 4 and the related discussion below). When oriented in that way, the lighting unit 17 and the driver compartment 8 are located on opposite sides of the longitudinal axis L and, thus, the lighting unit 17 and the driver 9 serve as counterweights to each other when the luminaire 1 is mounted to a pole.

As is clear from FIG. 1, the lighting unit 17 is arranged at a distance from the driver compartment 8 along the longitudinal axis L. Differently stated, the lighting unit 17 and the driver compartment 8 are separated along the longitudinal axis L. The separation distance depends on the position of the lighting unit 17. When the lighting unit 17 is oriented as in FIG. 1, this distance is approximately equal to the longitudinal length $I_2$ of the redirection module 14. The longitudinal length $I_2$ of the redirection module 14 is usually in the range from 20 cm to 30 cm, for example 25 cm.

The lighting unit 17 is in this case electrically connected to the driver 9 via a connector 20 and a cable 21. The connector 20 can for example be a bayonet connector. As can be seen in FIG. 3, the connector 20 is arranged inside the arm 15 and the redirection module 14, and the cable 21 is arranged inside the redirection module 14 and the housing 2. The electrical connection between the lighting unit 17 and the driver 9 is thus arranged entirely inside the luminaire 1, i.e. the connection is an interior connection.

The luminaire 1 is put in operation by connecting the driver 9 to an electrical power supply, such as the mains power grid. The driver 9 then supplies power to the lighting unit 17 which illuminates the surroundings of the luminaire 1.

Figure 4:
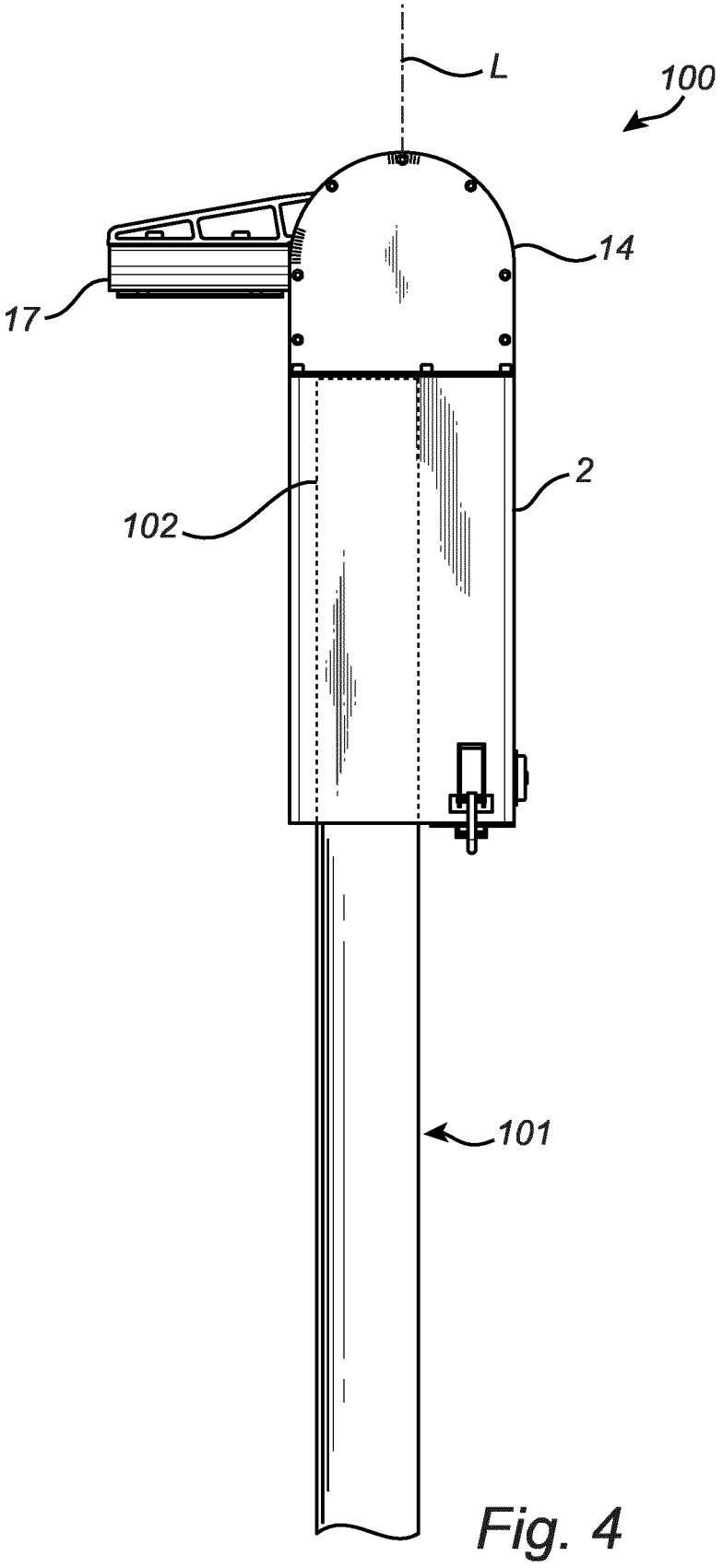
FIG. 4 shows a street lamp according to an embodiment of the invention.

With reference to FIG. 4, and with continued reference to FIGS. 1 to 3, a street lamp 100 will now be described. The street lamp 100 shown in FIG. 4 may for example be used to illuminate a part of a public road or parking lot and comprises a pole 101 and the luminaire 1 described above in connection with FIGS. 1 to 3. It should be noted that the entire length of the pole 101 is not illustrated in FIG. 4. The luminaire 1 is mounted on the pole 101. An end portion 102 of the pole 101 is inserted into the pole compartment 3, i.e. the end portion 102 is received by the pole compartment 3. The pole 101 is adapted to be installed on the ground in a vertically upright position and has a top end portion which is received by the pole compartment 3 of the luminaire 1. The longitudinal axis L of the luminaire 1 is thus parallel with the vertical. The lighting unit 17 is positioned so as to be located on an opposite side of the longitudinal axis L relative to the driver compartment 7. Light emitted by the lighting unit 17 is directed downwards. The direction of the emitted light can be adjusted by rotating the lighting unit 17 about the rotation axis R.

The person skilled in the art realizes that the present invention by no means is limited to the preferred embodiments described above. On the contrary, many modifications and variations are possible within the scope of the appended claims. For example, instead of being mounted on a vertically arranged pole, the luminaire can be mounted on a horizontally arranged pole that extends from the wall of a building. Also, the luminaire may be a "twin" luminaire comprising two lighting units and a redirection module that has two arms, each of the two lighting units being attached to a respective one of the two arms. The two arms may be independently rotatable.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A luminaire for mounting on a pole, comprising:

a lighting unit;

a driver compartment housing a driver electrically connected to the lighting unit; and a pole compartment adapted to receive an end portion of the pole, the pole compartment extending along a longitudinal axis (L) along which said end portion is arranged when received by the pole compartment, wherein the pole compartment and the driver compartment are arranged adjacent to each other in a direction (D) perpendicular to the longitudinal axis (L), and wherein the driver compartment and the lighting unit are arranged at a distance from each other along the longitudinal axis (L), wherein the lighting unit and the driver compartment are arranged on opposite sides of the longitudinal axis (L).

2. The luminaire according to claim 1, wherein the lighting unit is arranged to be rotatable about a rotation axis (R), the rotation axis (R) being perpendicular to the longitudinal axis (L) and to said direction (D).

3. The luminaire according to claim 2, further comprising a redirection module arranged between the lighting unit and the driver compartment along the longitudinal axis (L), wherein the lighting unit is mounted to the redirection module so as to be rotatable about the rotation axis (R).

4. The luminaire according to claim 3, wherein the redirection module comprises an arm rotatable about the rotation axis (R), and wherein the lighting unit is mounted to the arm.

5. The luminaire according to claim 1, wherein the lighting unit is electrically connected to the driver via an interior connection.

6. The luminaire according to claim 1, wherein the driver comprises a first heat sink and the lighting unit comprises a second heat sink, the second heat sink being separate from the first heat sink.

7. The luminaire according to claim 1, wherein the pole compartment is open that so as to allow the pole to be inserted along the longitudinal axis (L) into the pole compartment.

8. The luminaire according to claim 1, further comprising a locking member arranged inside the pole compartment, the locking member being fixable at different positions along an axis (A) parallel to said direction (D).

9. The luminaire according to claim 8, wherein the pole compartment comprises an inner wall, and wherein the inner wall and the locking member are capable of pressing against a pole inserted into the pole compartment at three or more contact regions.

10. The luminaire according to claim 1, wherein the driver compartment and the pole compartment are formed by a single housing.

11. The luminaire according to claim 10, wherein the housing is extruded.

12. A street lamp comprising a luminaire according to claim 1 and a pole for being installed on the ground in an upright position, wherein an end portion of the pole is inserted into the pole compartment of the luminaire.

* * * * *